US006718955B1

(12) United States Patent
Knight

(10) Patent No.: US 6,718,955 B1
(45) Date of Patent: Apr. 13, 2004

(54) ELECTRIC SUPERCHARGER

(76) Inventor: Thomas Geoffrey Knight, 22050 SW. 155 Ave., Miami, FL (US) 33170

( * ) Notice: Subject to any disclaimer, the term of this patent is extended or adjusted under 35 U.S.C. 154(b) by 0 days.

(21) Appl. No.: 10/423,590

(22) Filed: Apr. 25, 2003

(51) Int. Cl.[7] ..... F02B 33/00; F25B 41/00

(52) U.S. Cl. ..... 123/559.1; 123/565; 60/608; 475/5; 475/1; 417/16; 62/209

(58) Field of Search ..... 60/607, 608, 716; 123/565; 417/423.1, 16; 62/209; 475/1–9

(56) References Cited

U.S. PATENT DOCUMENTS

| | | | | | |
|---|---|---|---|---|---|
| 2,741,234 | A | * | 4/1956 | Wiseman | 123/559.1 |
| 2,839,038 | A | | 6/1958 | Middlebrooks, Jr. | 123/565 |
| 3,561,544 | A | * | 2/1971 | Farmer | 475/5 |
| 4,352,635 | A | * | 10/1982 | Saunders | 417/16 |
| 4,445,337 | A | * | 5/1984 | McCreary | 60/608 |
| 4,485,310 | A | * | 11/1984 | de Valroger | 123/565 |
| 4,514,991 | A | * | 5/1985 | Zinsmeyer | 62/209 |
| 4,724,817 | A | * | 2/1988 | Cook | 123/565 |
| 5,080,635 | A | * | 1/1992 | Martinez et al. | 475/5 |
| 5,577,385 | A | | 11/1996 | Kapich | 123/565 |
| 5,638,796 | A | | 6/1997 | Adams, III et al. | 123/565 |
| 5,887,576 | A | | 3/1999 | Wheeler, Jr. et al. | 123/559.1 |
| 6,082,340 | A | * | 7/2000 | Heimark | 123/559.1 |
| 6,135,098 | A | | 10/2000 | Allen et al. | 123/565 |
| 6,176,689 | B1 | | 1/2001 | Bumbel et al. | |
| 6,328,024 | B1 | * | 12/2001 | Kibort | 123/565 |
| 6,461,265 | B1 | * | 10/2002 | Graham et al. | 475/5 |
| 6,615,809 | B1 | * | 9/2003 | Martin | 123/559.1 |
| 2002/0059858 | A1 | | 5/2002 | Wheeler, Jr. et al. | 123/559.1 |

FOREIGN PATENT DOCUMENTS

| | | | | | |
|---|---|---|---|---|---|
| JP | 63180753 | A | * | 7/1988 | 475/1 |

* cited by examiner

*Primary Examiner*—Thomas Denion
*Assistant Examiner*—Thai Ba Trieu
(74) *Attorney, Agent, or Firm*—Becker & Poliakoff PA; Patricia E. McQueeney

(57) ABSTRACT

The present invention relates to a multiple electric motor driven centrifugal air compressor, for example, for gasoline or diesel engine powered vehicles.

2 Claims, 4 Drawing Sheets

ELECTRIC SUPERCHARGER

FIELD OF THE INVENTION

The present invention relates to a multiple electric motor driven centrifugal air compressor, for example, for gasoline or diesel engine powered vehicles.

BACKGROUND OF THE INVENTION

There is a problem with previous centrifugal air compressor designs when used as an engine's supercharger, in that a single electrical motor is ineffective in providing the required power needed to produce the air flow (cfm) and minimum boost pressure (at least 5 psi) that results in a noticeable horsepower (hp) increase. A single electric motor is limited by the motor's amperage draw (watts) and to the capacity of a vehicle's battery(s) and electrical system (i.e. battery cables).

The present invention uses existing and well-known centrifugal air compressor (supercharger) theory and design, then combines that with two or more high power electric motors. The multiple electric motors have drive pulleys affixed to one end inside a common housing, which then drives a pulley that is on a common shaft with the centrifugal supercharger's impeller. The centrifugal supercharger's impeller is turned by a driven pulley which is connected by an endless belt to said pulleys that are affixed to the multiple electric motors mounted to a common housing. Previous electric superchargers have used a single electric motor connected to the centrifugal compressor on a common fixed shaft.

Any engine's power output can be increased an additional amount by forcing air into the engine at pressures above atmospheric pressure (14.7 psi). Any given engine will experience an average one hundred percent (100%) increase in power with the addition of a second atmosphere of pressure (14.7 psi+14.7 psi) to the intake manifold. To create additional pressure (boost) and additional airflow (cfm) through an engine takes a considerable amount of power. For example, a 2.0 liter, 4 cylinder engine that turns 6000 rpm will flow 216 cfm. To flow 50% more air (324 cfm) and 50% more pressure (7.4 psi) would require 14 hp. (14 hp=10,444 watts (14 hp×746 watts/hp)). Using common electrical laws, 10,444 watts is equal to 870 amps (watts=volts×amps). Therein lies one of the problems with the prior art. It is virtually impossible to get 870 amps at 12 volts from one electric motor. Another problem is also evident, a single electric motor sufficient to make 14 hp would be extremely heavy, very large and would make fitment an impossibility on most vehicles. The rotational speed of the compressor impeller (rotor, wheel) would also be an additional problem. A centrifugal compressor, by design, requires extremely high rotational speeds. These rotational speeds are 30,000 rpm and higher. To design a 12 volt motor capable of 14 hp at 30,000 rpm is impractical, if not impossible.

The prior art has additional shortcomings in the vehicles battery(s) and cables used to power the supercharger. Standard automotive batteries are rated using cold cranking amps (cca). Factory supplied standard automotive batteries are typically rated at 500 cca. The battery cables pose an additional limitation. The largest standard automotive battery cable is the #2 size, rated at 205 amps continuous, or 275 amps momentary. 205 amps×12 volts=2460 watts, or 3.3 hp. The typical automotive starter is rated at 1 to 1.5 hp, so the #2 cable is adequate for that application. The present supercharger design draws 14,000 watts (18 hp), or 1166 amps at 12 volts. It is therefore impossible for a single battery and set of battery cables to provide the necessary watts to generate 18 hp.

SUMMARY OF INVENTION

One purpose of the present invention is to allow for electric supercharger performance previously unattainable. A single electric motor is limited by size, weight, amperage, rpm rotational speed, the battery, and battery cable system. By using multiple (two or more) electric motors combined with separate multiple batteries and battery cable/wiring, each electric motor having its own set of battery(s), relay(s) and cables, the previous power limitations are overcome. By using an overdrive pulley and belt design, the required compressor impeller rotational speeds are obtained.

The present invention obtains the desired higher than atmospheric pressure that results in a large increase in horse power (HP) on engines.

The present invention utilizes two (2) or more 3,000+ watt, high RPM (9000+ RPM) motors, each motor having a large drive pulley affixed to one end, on a common mounting plate/housing with parallel shafts turning a smaller driven pulley which turns the centrifugal supercharger impeller. The approximate overdrive ratio is between 2.5:1 and 4:1. This step-up ratio is necessary to obtain the desired 30,000+ impeller rotational speeds to create 5+ psi boost pressure on engines up to 4.0 liters. Larger engines would, of course, require two or more electric superchargers.

One embodiment of the present invention provides a compact design of three electric motors, with each motor measuring five (5) to six (6) inches long, making the complete electric supercharger eleven (11) to twelve (12) inches long, ten (10) inches in diameter, and weighing approximately 38 lbs. This is similar in size to popular centrifugal superchargers.

One embodiment of the present invention incorporates the use of three separate batteries to power the supercharger unit—one battery per electric motor, with one complete set of battery cables and relays per battery/electric motor. The three sets of battery cables are to be larger than production battery cables, 2/0 cables rated at 325 amps (continuous) per cable. The 2/0 cables have a momentary rating of 450 amps (30 seconds) per cable, allowing for 1350 amps or 16,200 watts (450 amps×3 batteries×12 volts).

One embodiment of this invention uses two idler pulleys, with one acting as an adjustable tensioner with the endless belt wrapping around the three drive pulleys, the one driven pulley and both idler pulleys.

Another embodiment of the present invention uses an endless belt wrapping around three drive pulleys, thereby driving one driven pulley, and may nor may not use one or more tensioner/idler pulley(s).

Another embodiment of the present invention uses a double sided endless drive belt that wraps around the three drive pulleys, one driven pulley and may or may not use one or more tensioner/idler pulley(s).

By using two or more motors and a variety of centrifugal supercharger components, a system can be made for a specific application—such as a motorcycle, snowmobile, watercraft, up to a semi-tractor trailer truck or large industrial stationary engine. In addition, a standard size could be produced to cover a large segment of the most popular vehicles. Because the horsepower and watts would remain constant, a smaller engine could receive higher boost pressure (psi), while a larger engine would receive more air flow (cfm), but less boost pressure (psi). Known fan laws state that if horsepower (hp) is constant, and pressure (psi) drops, then air flow (cfm) increases, and as boost pressure (psi) increases, then air flow (cfm) is reduced.

Another object of the present invention is to make available, at a reasonable cost, a high performance electric supercharger. To this end, the majority of components are common and already available. With suitable modifications, the backing plates, compressor housings, compressor impellers are standard turbo-supercharger components from: Garrett Allied Signal, Holset, Schwitzer, 1H1-Warner, Mitsubishi, etc. The electrified motors can be high amperage 6+ volt aftermarket motors modified for this application from Delco-Remy, Nippon-Denso, etc. The drive belt and pulley housing can be any composition capable of high rotational speeds and stresses associated with this application. The pulleys can be steel, aluminum, or any composite material. The battery cables can be standard high amp 2/0 welding cable, and the batteries can be automotive type available at any auto parts store. The shaft bearings and tensioner bearings can be class 7 (rated at 30,000 rpm) or class 9 (rated at 60,000 rpm) aerospace ceramic ball bearings, Barden ceramic ball bearings (part no. C202SST5), and Koyo high speed steel ball bearings (part. no. 6205ZZCMP5GK7).

DETAILED DESCRIPTION

Throughout the specification and claims, the terms "air compressor" and "supercharger" are used interchangeably and refer to the component that supplies air under pressure to the cylinders of an internal combustion engine.

Throughout the specification and claims, the terms "boost" and "pressure" are used interchangeably to refer to the amount of air pressure produced by the supercharger.

Throughout the specification and claims, the terms "gears" and "pulleys" are used interchangeably to refer to a part, such as a disk, wheel, or section of a shaft, for supporting, guiding, or transmitting force.

Throughout the specification and claims, the terms "step up" refers to the gear ratio necessary to spin the impeller at high rotational speeds.

Throughout the specification and claims, the term standard 2 gauge wire indicates a battery cable that can safely carry 125 amps continuously.

Throughout the specification and claims, the term standard 2/0 gauge wire indicates a battery cable that can safely carry 225 amps+continuously.

Throughout the specification and claims,

"pounds per square inch" are depicted as "psi,"

"horsepower" is depicted as "hp,"

"revolutions per minute" are depicted as "rpm," and

"1,000" is depicted as "K."

FIGS. 1 through 5 provide several embodiments of the present invention, in which are indicated by like numbers.

Figure 1:
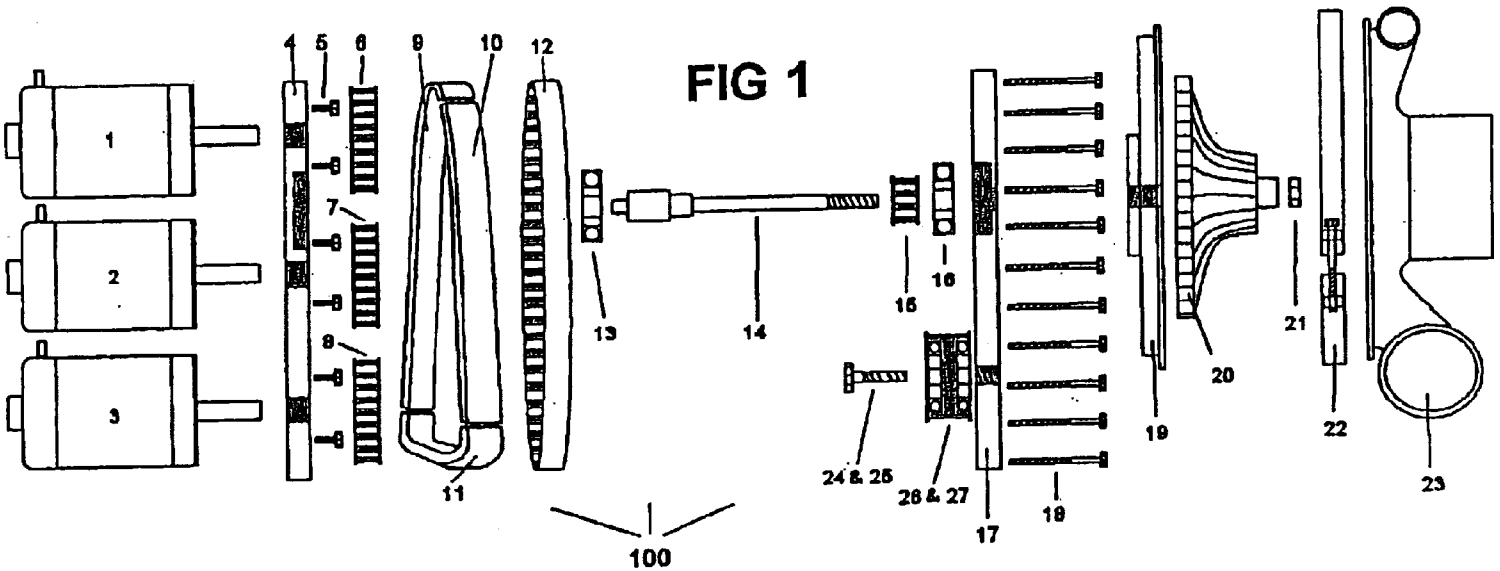
FIG. 1 shows an exploded perspective of one embodiment of the multiple electric motor driven centrifugal air compressor of the present invention.

FIG. 1 shows an exploded perspective of one embodiment of the multiple electric motor driven centrifugal air compressor 100 of the present invention. The multiple electric motor driven centrifugal air compressor 100 contains three electric motors (1, 2, 3). These electric motors can be any high amp (6 volts or more) electric motors, rewound and modified for this application. Each electric motor is connected to a direct current energy source (not shown). The direct current energy source (not shown) can be any object capable of producing approximately twelve (12) volts, such as a standard twelve-volt battery. Each electric motor should be capable of producing 12,000 to 18,000 RPM.

The three electric motors (1, 2, 3) of the multiple electric motor driven centrifugal air compressor 100 shown in FIG. 1 are attached to three pulleys (6, 7, 8) through a pulley housing plate 4. The three pulleys (6, 7, 8) can be connected to the three electric motors (1, 2, 3) by bolts, press fitting or any suitable means. The electric motors (1, 2, 3) are mounted to the pulley housing plate 4 by electric motor mounting bolts (5—shown in FIGS. 2 and 3). However, any known connection mechanism can be used to connect the electric motors (1,2,3) to the housing plates (4 & 17).

Figure 2:
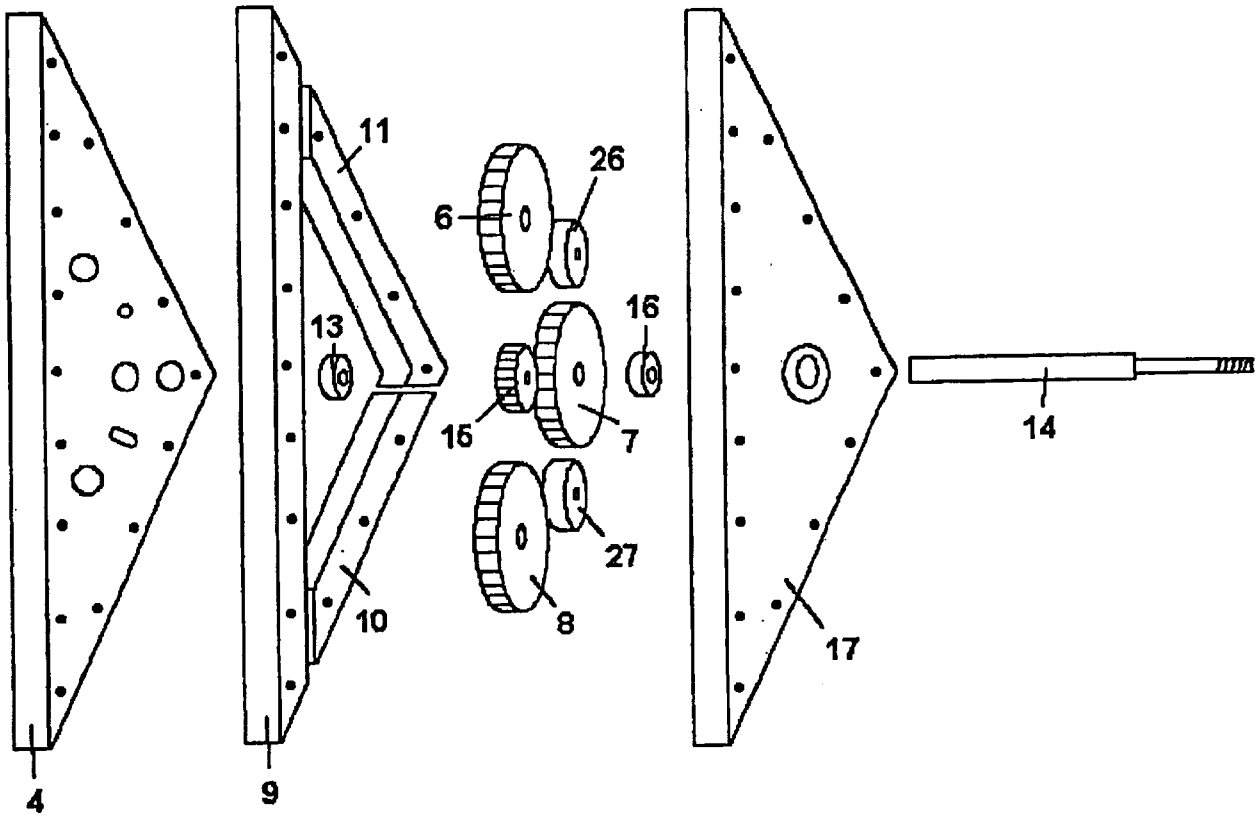
FIG. 2 provides an exploded perspective of the spacers and gears of another embodiment of the multiple electric motor driven centrifugal air compressor of the present invention.
Figure 3:
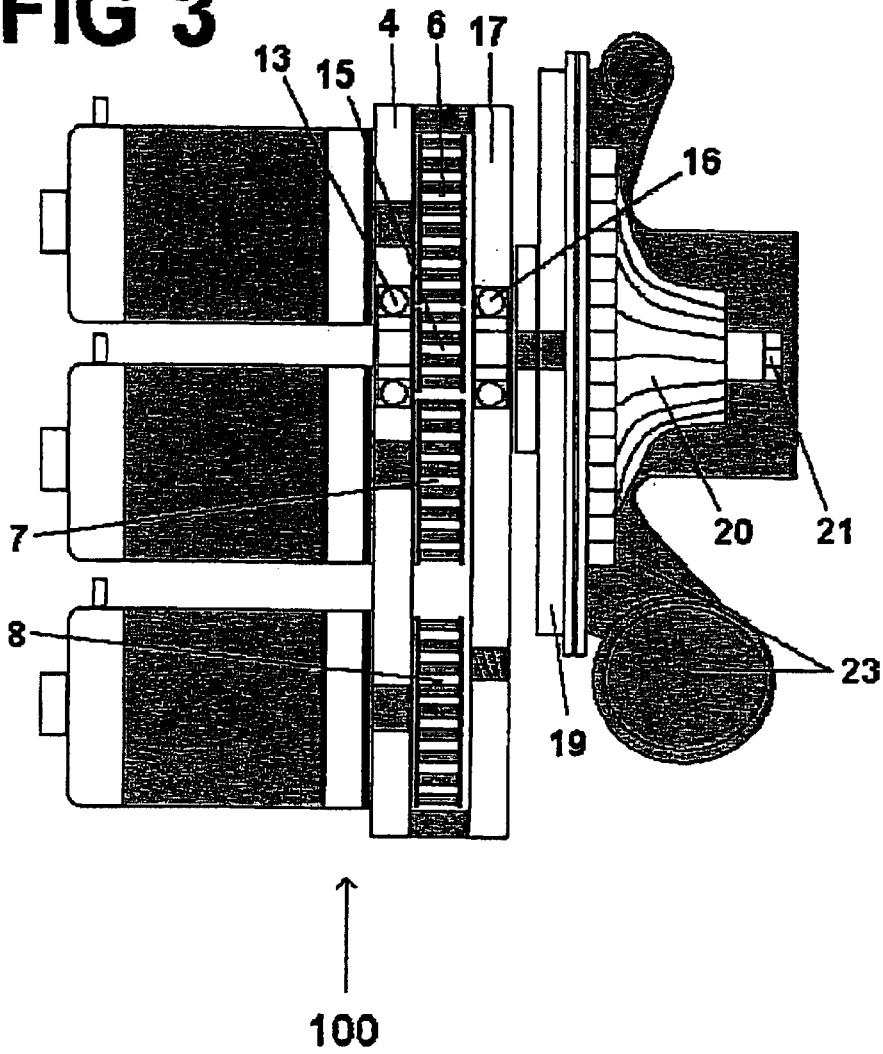
FIG. 3 provides a side perspective of one embodiment of the multiple electric motor driven centrifugal air compressor of the present invention.

The pulleys (6, 7, 8) are protected from the environment by the combination of pulley housing plates 4 and 17 and pulley housing side spacers (9, 10, 11—shown in FIGS. 2 and 3). Pulley housing plate 17 is connected to pulley housing plate 4 by pulley housing bolts (18—shown in FIGS. 2 and 3). However, as with the electric motor mounting bolts (5—in FIGS. 2 and 3), any known connection mechanism can be used. The pulley housing plates 4 and 17 and pulley housing side spacers (9, 10, 11) are comprised of normal engine materials, including, but not limited to aluminum, stainless steel and metal. Depending upon the application, the pulley housing plates 4 and 17 and pulley housing side spacers (9, 10, 11) comprise an average width of 1.5 inches and an average thickness of 0.5 inches.

Electric motor 1 drives pulley 6. Electric motor 2 drives pulley 7. Electric motor 3 drives pulley 8. Pulleys 6, 7, and 8 drive compressor shaft pulley 15 by means of one or more one- or two-sided drive belts (12—shown in FIGS. 2 through 4). The pulleys can be composites or metal. The pulleys can be cog drive or groove. The drive belt can be V-belt, multi-groove V-belt, toothed timing belt, or any suitable belt for this application. The belt can be constructed of rubber, urethane, fiberglass, stranded, or any suitable materials.

Compressor shaft pulley 15 is connected to the compressor shaft (14—shown in FIGS. 2 and 3) via compressor shaft bearing 16 located in pulley housing plate 17. There is an additional compressor shaft bearing 13 located in pulley housing plate 4. Compressor shaft bearings 13 and 16 support the rotating compressor shaft 14.

Compressor shaft pulley 15 turns the compressor impeller 20 of the multiple electric motor driven centrifugal air compressor 100 of the present invention. Compressor shaft pulley 15 is connected to the compressor impeller 20 via a compressor shaft 14 and compressor shaft retaining nut 21. As the compressor shaft pulley 15 is powered by the three electric motors (1, 2, 3), connected to pulleys (6, 7, 8), the resultant power available to multiple electric motor driven centrifugal air compressor 100 is greater than experienced by previous centrifugal air compressors.

Compressor impeller 20 is located between compressor housing backing plate 19 and compressor housing 23. The compressor housing backing plate 19 and the compressor housing 23 are connected by a compressor housing band clamp (22—in FIG. 3). However, other connection mechanisms may be used.

FIG. 2 provides an exploded perspective of one of the embodiments of the pulley housing plate 4, electric motor mounting bolts 5, pulleys 6, 7, 8, pulley housing side spacers 9, 10, 11, drive belt 12, compressor shaft bearing 13, compressor shaft 14, compressor shaft pulley 15, compressor shaft bearing 16, and pulley housing plate 17 of the multiple electric motor driven centrifugal air compressor 100 depicted in FIG. 1. As depicted in FIG. 1, the pulley housing side spacers 9, 10, 11 form a rounded triangle. As depicted in FIG. 2, the pulley housing side spacers 9, 10, 11 form a pointed triangle. The present invention is not limited to these two shapes nor this number of spacers. One of ordinary skill in the art would recognize the ability to alter the number of spacers and or shape of the spacer housing based on the desired outcome and location of the multiple electric motor driven centrifugal air compressor 100.

FIG. 3 provides a side perspective of one embodiment of the multiple electric motor driven centrifugal air compressor 100 shown in FIG. 1.

Figure 4:
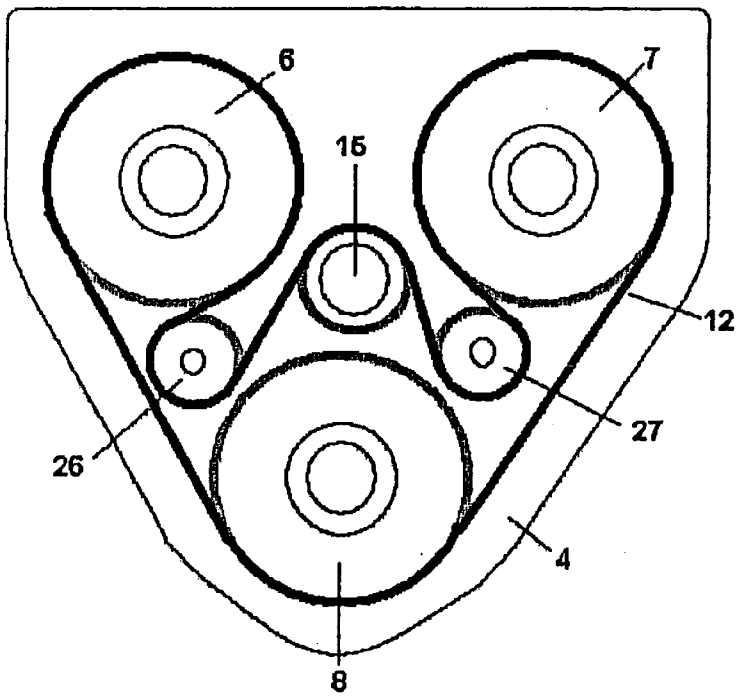
FIG. 4 provides a sectional view of one belt configuration utilized in one embodiment of the present invention.

FIG. 4 provides a sectional view of the belt configuration utilized in one embodiment of the present invention. FIG. 4 shows idler pulleys 26 and 27, which maintain tension in the belt 12 used to connect the pulleys (6, 7, 8, 15).

Figure 5:
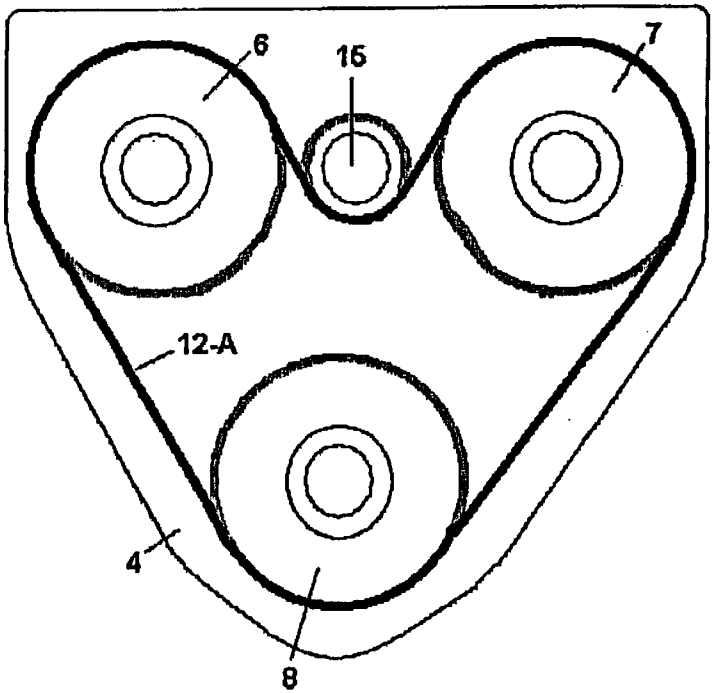
FIG. 5 provides a sectional view of one of several alternate belt configurations utilized in another embodiment of the present invention.

FIG. 5 provides a sectional view of an alternate belt configuration utilized in another embodiment of the present invention. In one of several alternative embodiments, the pulleys 6, 7, and 8 utilize a two-sided belt 12-A to drive compressor shaft pulley 15, thereby eliminating the need for the idler pulleys 26 and 27 of FIG. 4.

The Figures have been provided for exemplary purpose only. It is to be understood that the invention is not limited to the embodiments disclosed in the Figures, but is intended to cover various modifications and equivalent arrangements included within the spirit of the invention, which are set forth in the appended claims, and which scope is to be accorded the interpretation so as to encompass all such modifications and equivalent structures.

Numbers

1 Electric motor
2 Electric motor
3 Electric motor
4 Pulley housing plate (motor side)
5 Electric motor mounting bolt(s)
6 Pulley
7 Pulley
8 Pulley
9 Pulley housing side spacer
10 Pulley housing side spacer
11 Pulley housing side spacer
12 Drive belt
13 Compressor shaft bearing (motor side)
14 Compressor shaft
15 Compressor shaft pulley
16 Compressor shaft bearing (compressor side)
17 Pulley housing plate (compressor side)
18 Pulley housing bolt(s)
19 Compressor housing backing plate
20 Compressor impeller (wheel)
21 Compressor shaft retaining nut
22 Compressor housing band clamp*
23 Compressor housing
24 Idler pulley retaining bolt**
25 Idler pulley retaining bolt**
26 Idler pulley**
27 Idler pulley**
100 Invention

*bolts and clamps can be used instead of band clamp
** Idler pulley(s) and retaining bolt(s) may or may not be used on models with double sided belt or single sided belt.

I claim:

1. An electric motor driven centrifugal air compressor comprising

A. housing that contains two or more pulleys and one drive belt;

B. two or more electric motors,

C. a centrifugal air compressor;

wherein each of said two or more electric motors is individually connected to a direct current energy source, wherein each of said two or more electric motors drives one of said two or more pulleys, wherein said two or more pulleys drive said one drive belt, and wherein said one drive belt powers said centrifugal air compressor.

2. The electric motor driven centrifugal air compressor of claim 1 wherein said direct current energy source is a battery.

* * * * *